US009366014B2

(12) United States Patent
Wawrla

(10) Patent No.: US 9,366,014 B2
(45) **Date of Patent: *Jun. 14, 2016**

(54) SANITARY FITTING COMPRISING A FITTING HOUSING AND A CONTROL UNIT

(75) Inventor: Andreas Wawrla, CH-Widnau (CH)

(73) Assignee: Aquis Sanitaer AG, Rebstein (CH)

( * ) Notice: Subject to any disclaimer, the term of this patent is extended or adjusted under 35 U.S.C. 154(b) by 304 days.

This patent is subject to a terminal disclaimer.

(21) Appl. No.: 14/004,893

(22) PCT Filed: Mar. 14, 2012

(86) PCT No.: PCT/EP2012/001133

§ 371 (c)(1),
(2), (4) Date: Dec. 23, 2013

(87) PCT Pub. No.: WO2012/123113

PCT Pub. Date: Sep. 20, 2012

(65) Prior Publication Data

US 2014/0124048 A1 May 8, 2014

(30) Foreign Application Priority Data

Mar. 14, 2011 (DE) ..... 10 2011 013 916

(51) Int. Cl.
*E03C 1/04* (2006.01)
*E03C 1/05* (2006.01)

(52) U.S. Cl.
CPC ..... *E03C 1/04* (2013.01); *E03C 1/0403* (2013.01); *E03C 1/055* (2013.01); *Y10T 137/598* (2015.04)

(58) Field of Classification Search
CPC ..... E03C 1/0401
USPC ..... 4/676–678
See application file for complete search history.

(56) References Cited

U.S. PATENT DOCUMENTS 4,941,506 A * 7/1990 Bergmann ..... F16K 11/0787 137/625.17

FOREIGN PATENT DOCUMENTS

| | | | |
|---|---|---|---|
| DE | G 89 02 238.6 | U1 | 7/1989 |
| DE | 100 22 350 | A1 | 11/2001 |
| DE | 10 2006 060 929 | B4 | 11/2008 |
| JP | 2008-248474 | | 10/2008 |
| WO | WO 2012/123113 | A2 | 3/2012 |

* cited by examiner

*Primary Examiner* — Lori Baker
(74) *Attorney, Agent, or Firm* — Breneman & Georges

(57) ABSTRACT

A sanitary fitting having a fitting housing with a control unit having at least one control element which is preferably an electrically actuatable throughflow valve for controlling the water flow through at least one water line by closing and opening the water line which sanitary fitting can be maintained or repaired with particularly little effort particularly in applications where vandalism is a considerable concern. This is achieved by having an assembly cover, which can be released from the fitting main body and which covers at least one shut-off device in the fitting main body which has a second control element which serves for shutting off the water line in the fitting housing to provide access for maintenance and servicing.

20 Claims, 4 Drawing Sheets

SANITARY FITTING COMPRISING A FITTING HOUSING AND A CONTROL UNIT

CROSS-REFERENCE TO RELATED APPLICATIONS

This application contains subject matter related to U.S. application Ser. No. 14/004,885 filed Sep. 12, 2013 titled SANITARY FITTING COMPRISING A FITTING HOUSING AND AN ELECTRICAL CONTROL UNIT and U.S. application Ser. No. 14/004,898 filed Sep. 12, 2013 titled SANITARY FITTING HAVING A FITTING HOUSING AND A CONTROL UNIT.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS WEB)

Not Applicable.

STATEMENT REGARDING PRIOR DISCLOSURES BY THE INVENTOR OR A JOINT INVENTOR

Not Applicable.

REFERENCE TO A "MICROFICHE APPENDIX"

Not Applicable.

BACKGROUND OF THE INVENTION (1) Field of the Invention

The invention relates to a "sanitary fitting having a fitting housing and a control unit" as per the preamble of claim 1.

(2) Description Of Related Art Including Information Disclosed Under 37 C.F.R. §1.97 and 1.98

Documents DE 100 22 350 A1 or DE 10 2006 060 929 B4, for example, disclose sanitary fittings having a fitting housing and having a control unit, wherein a shut-off valve is arranged within a fitting holder. The fitting holder is, and remains, fixedly connected to the installation site of the fitting. The installation site may in this case be a sanitary body such as a washbasin, etc., or may be a countertop.

By contrast, the fitting housing can be easily removed from the fitting holder, wherein, at the same time, one or more shut-off valves shut off or lock the water lines. Correspondingly, the water lines are simultaneously opened again when the fitting housing is connected to the fitting holder.

Said fittings permit, for example, maintenance or repair of individual components of the fitting, such as for example mixing valve or dirt filter, or an exchange of the batteries/storage batteries or of further electrical components in the case of electrical fittings, without water escaping from the lines and without it being necessary to close the angle valves, which are normally arranged below the washbasin, of the water lines.

This is advantageous because, for example in the case of bathtubs or the like, such angle valves are not (easily) accessible or are not provided. The latter applies in particular also in public or semi-public areas where such angle valves would be manipulated or even damaged through vandalism.

Specifically for applications in public or semi-public areas, however, easily dismountable fittings mentioned in the introduction cannot be used specifically owing to the problem of vandalism, because such fittings would already be damaged or even removed within a short period of time.

BRIEF SUMMARY OF THE INVENTION

It is an object of the invention to propose a sanitary fitting of the type mentioned in the introduction which can be maintained or repaired with particularly little effort, specifically also in applications in which the demands with regard to vandalism are of considerable significance.

The object is achieved by means of a sanitary fitting having the features of claim 1. Advantageous embodiments and refinements of the invention are possible by means of the measures specified in the dependent claims.

Accordingly, a sanitary fitting according to the invention is characterized in that the fitting housing comprises at least one fitting main body that can be firmly fixed at the installation site and comprises an assembly cover, which can be released from the fitting main body and which covers a housing opening, for the opening of the fitting housing for maintenance and/or servicing purposes, and in that, within the fitting main body, there is provided at least one shut-off device which has a second control element and which serves for shutting off the water line.

By means of the assembly cover according to the invention in combination with the second control element, preferably shut-off valve, arranged within the fitting main body firmly fixed at the installation site, it is possible for individual components or all of the relevant components of the fitting to be serviced or exchanged/repaired. Here, the second control element preferably shuts off the water flow or the water line/water lines in an advantageous manner such that downstream hydraulic and if appropriate electrical components, such as for example dirt filter, mixing valve, throughflow valve, throughflow limiter, jet regulator, water turbine with electrical generator, water line sections, seals or the like, can be serviced, in particular removed, that is to say dismounted, and replaced or repaired without water escaping. For this purpose, no angle valve conventionally arranged below the sanitary body such as washbasin or the like is necessary, or said angle valve need not additionally be turned off or closed. Accordingly, said angle valve or upstream shut-off valve may also be completely or always omitted when using the sanitary fitting according to the invention, which reduces costs and assembly outlay.

The assembly cover is preferably arranged or mounted on the fitting main body so as to be secured against vandalism. For this purpose, said assembly cover can advantageously be fitted in an inconspicuous manner. For example, the edge may be "concealed" or disguised as a design line, such that inexperienced persons cannot even recognize that a separate cover is provided here.

Secondly, a special tool may be provided for releasing or dismounting the assembly cover. In this way, too, it is possible, as an alternative to or in combination with the "disguise", for dismounting through vandalism to be prevented in an effective manner.

The second control element is advantageously arranged upstream of the first control element as viewed in the flow direction of the water flow. In this way, the first control element or valve does not need to be actuated in order, if required, to dismount or service relevant components of the fitting according to the invention.

The cross section of the housing opening is advantageously larger than a cross section of the first control element and/or of a dirt filter for filtering the water flow and/or of at least one throughflow regulator for regulating the water flow rate and/or of at least one turbine, which drives an electrical generator, for utilizing the flow energy of the water flow. In this way, the first control element and/or the dirt filter and/or the throughflow limiter etc. may advantageously be removed in each case individually, and/or jointly as a service unit or structural unit, from the fitting main body via the free assembly opening. Dismounting of the entire fitting or of the fitting main body can be dispensed with. This is highly advantageous, in particular for maintenance/service or repair, specifically with regard to vandalism in public or semi-public areas. Not only hydraulic components but also electrical components can, according to the invention, be advantageously removed and reinstalled through the assembly opening.

It is advantageous for the first control element to comprise at least one dirt filter for filtering the water flow and/or at least one throughflow regulator for regulating the water flow rate and/or at least one turbine, which drives an electrical generator, for utilizing the flow energy of the water flow. It is achieved in this way that the electrical or first control element or throughflow valve is formed as a service unit or a valve unit together with essential hydraulic components, and can be dismounted from and reinstalled in the fitting main body in an advantageous manner. This may be necessary for example for maintenance, servicing, repair and replacement. This improves the economical operation of the sanitary fitting according to the invention.

It is preferable for at least one actuation unit to be provided for the actuation of the second control element. In the case of a mechanical first control element or throughflow valve, this may be in the form of a rotary handle and/or lever and/or in the form of the assembly cover.

In one particular refinement of the invention, the actuation unit is in the form of a fixing device for fixing and releasing of the first control element and/or the service unit. It is achieved in this way that the water line or the water flow is shut off or blocked already during the dismounting or release of the first control element or of the service unit. A corresponding arrangement may also be realized with regard to the dirt filter and/or throughflow limiter and/or the turbine and/or the electrical generator or the like. That is to say that simply the release/dismounting or removal of the first control element and/or of the service unit has the effect that, simultaneously or in a manner directly coupled therewith, the second control element/shut-off valve or shut-off device that has hitherto been open is closed too. Thus, the shut-off water line is simultaneously severed. A corresponding situation applies to the mounting process or the fixing of the first control element/service unit, and the opening, coupled therewith, of the second control element or of the shut-off device.

The shutting-off of the second control element preferably takes place at least partially by means of a rotational movement or a rotational travel, in particular by means of rotation during the release of the first control element or of the service unit or valve unit. For example, the fixing device is in the form of a bayonet coupling. An advantageous shutting-off and sealing of the water line or of the water flow in the fitting is attained in this way. The valve unit or the first control element or the like is rotated for example counterclockwise for example by means of a bayonet (for example 60°), the second control element or service valve is then closed, and the first control element or the entire valve unit together with filter, throughflow regulator and magnetic valve etc. can be removed. Installation takes place in the reverse sequence.

It is basically possible for the first and/or indeed the second control element to be formed as a purely mechanical shut-off valve with an actuation element in the form of a rotary handle, lever or the like. Alternatively, or in combination with this, it is also possible for an electrical and if appropriate also manually actuable first control element/valve, by means of which the water outlet is regulated, to be provided. In the case of an electrical actuation, this may advantageously be realized by means of a sensor, infrared sensor or the like, and/or by means of an electrical switch as an actuation element.

It is also conceivable for the assembly cover to be formed as an actuation element of the second control element or shut-off valve and/or for a blocking unit to be placed in operative connection with the assembly cover, such that for example a mechanism actuates the second control element. It is achieved in this way that the water flow is shut off or blocked already upon the dismounting or opening of the assembly cover.

In one advantageous variant of the invention, the assembly cover comprises at least one actuation element for actuating in particular the first and/or if appropriate the second control element. It is advantageously possible in this way for the outflow of water to be manually started and/or stopped by the user.

The assembly cover advantageously comprises at least one solar cell for solar electricity generation and/or comprises a display unit for displaying parameters of the water flow and/or parameters of the control unit. In this way, it is possible to realize substantially energy-autonomous operation, and/or to provide for the user an advantageous display of essential parameters or information relating to the sanitary fitting according to the invention. Such parameters or information may for example be actual temperature of the water, set nominal temperature, whether or not a fault is present and/or at which component a fault is present, automatic timing, a set water outflow duration, energy reserves of the battery/storage battery, or the like.

Particular designs of the sanitary fitting according to the invention may be in combinations or as alternatives, that it is an electronic sanitary fitting, wherein, in the fitting body, there is integrated a shut-off valve for the water feed, which shut-off valve can be opened and closed by means of a unit and is opened/closed upon the removal/installation of a service module (unit hereinafter=service module)

the service module is the actuation element of the shut-off valve, the shut-off valve is opened/closed by means of a rotational movement, in that the service module comprises a valve, in that the service module comprises a flow rate limiter, in that the service module comprises a dirt filter, in that the service module is mounted/dismounted by means of a rotational movement, for example bayonet coupling, in that the service module is implemented with a color coding for distinguishing between different designs, in that the service module can be installed/removed only in a positioning manner.

Particular advantages of the invention: Normal washbasin fittings are usually connected by hoses or pipes to angle valves. The angle valves serve for shutting off the water supply when repair or maintenance work has to be performed on the fitting. Such maintenance work includes for example the dirt screens having to be cleaned or exchanged. The angle valves are often only poorly accessible, below the washbasin, and are often accessible with particular difficulty owing to fixtures below the washbasin.

It is achieved according to the invention that the maintenance and repair work is made possible in a particularly simple manner and with easy access. The invention makes it possible for all the work on all of the hydraulic components to be performed "above the washbasin", without the fitting being dismounted and without the need to operate any shut-off elements for the water supply.

The water supply is automatically interrupted/shut off (within the fitting body) as a result of the removal of the service unit. It is thus possible for all maintenance work to be performed in a convenient and simple manner. Upon reinstallation, the integrated shut-off valve is opened again, and the fitting is ready for use.

BRIEF DESCRIPTION OF THE SEVERAL VIEWS OF THE DRAWINGS

An exemplary embodiment of the invention is illustrated in the drawing and will be explained in more detail below on the basis of the figures, with further advantages being indicated.

In detail.

DETAILED DESCRIPTION OF THE INVENTION INCLUDING BEST MODE

Figure 1:
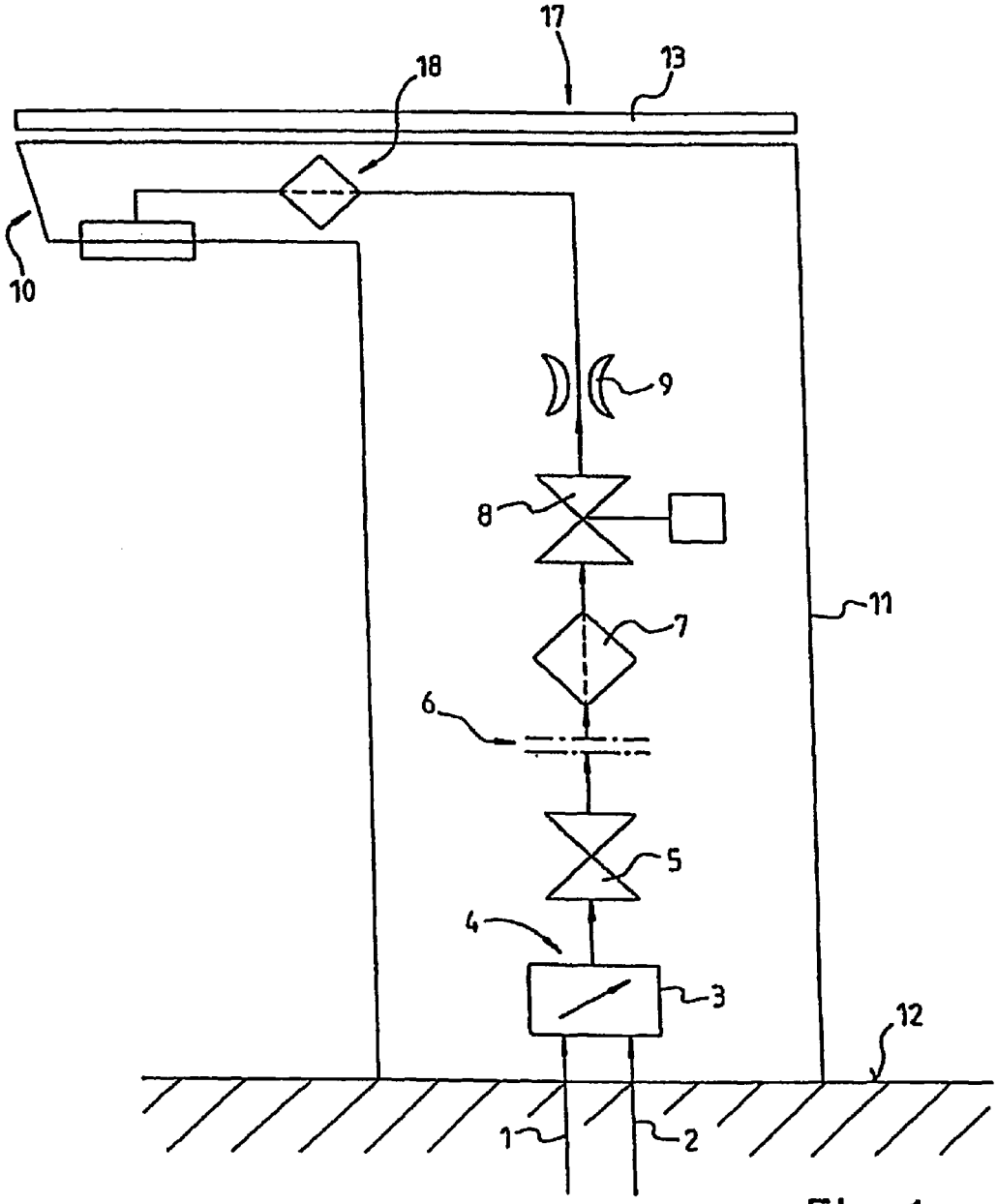
FIG. 1 shows a schematic block circuit diagram of a sanitary fitting according to the invention.
Figure 2:
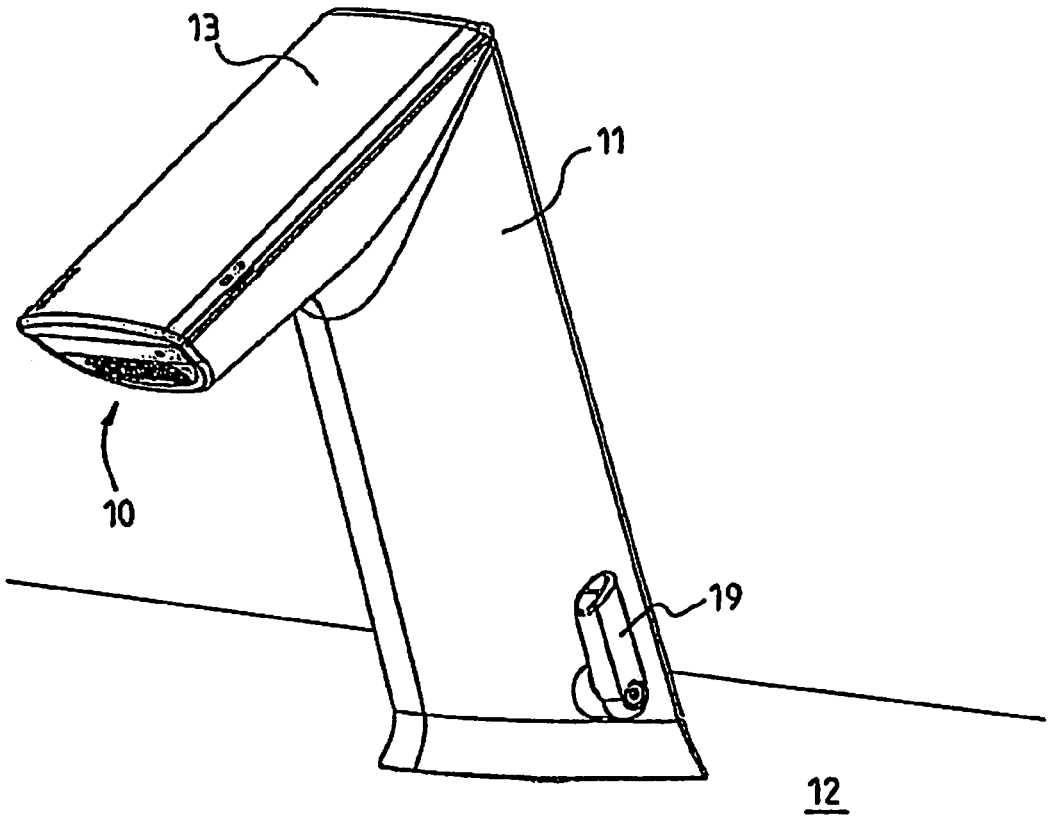
FIG. 2 shows a schematic illustration of a sanitary fitting according to the invention.
Figure 3A:
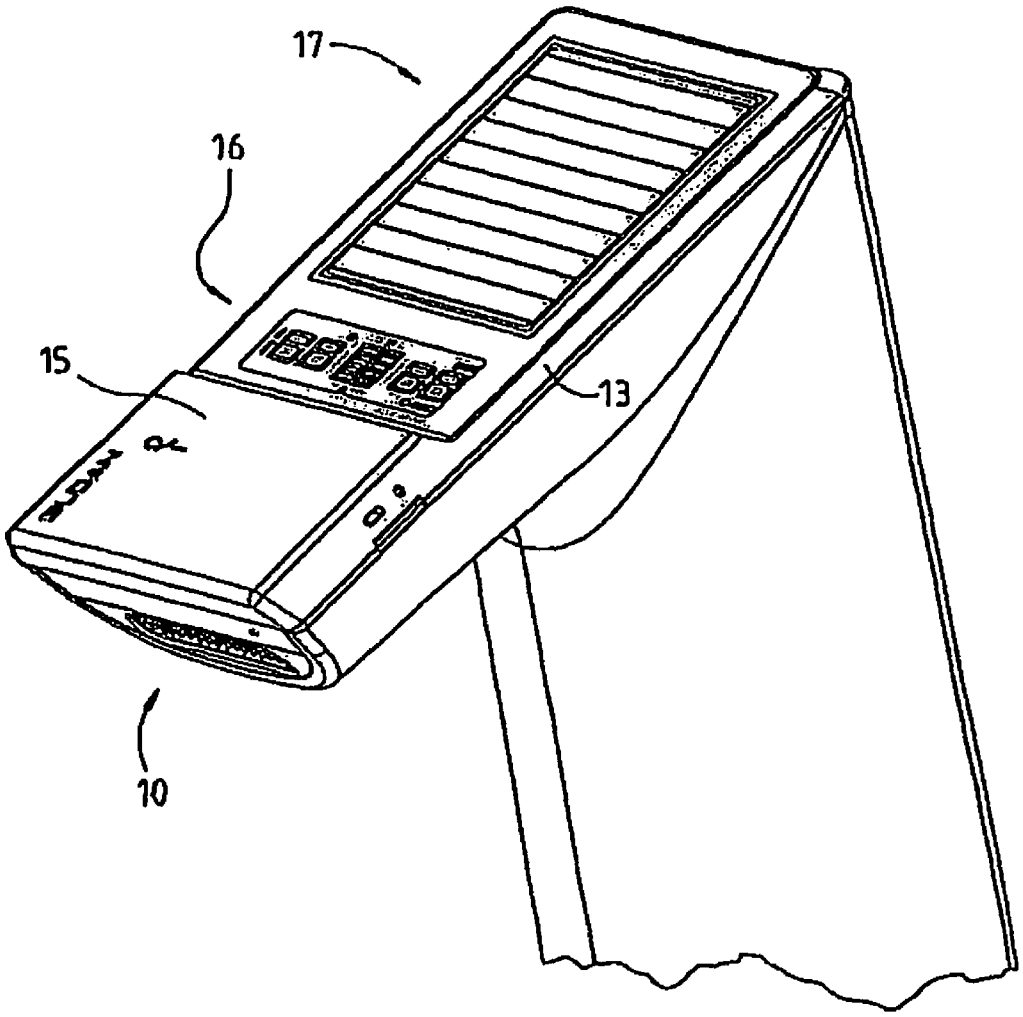
FIG. 3 shows a schematic illustration of a further sanitary fitting with a display according to the invention in a detail and in an exploded illustration.
Figure 3B:
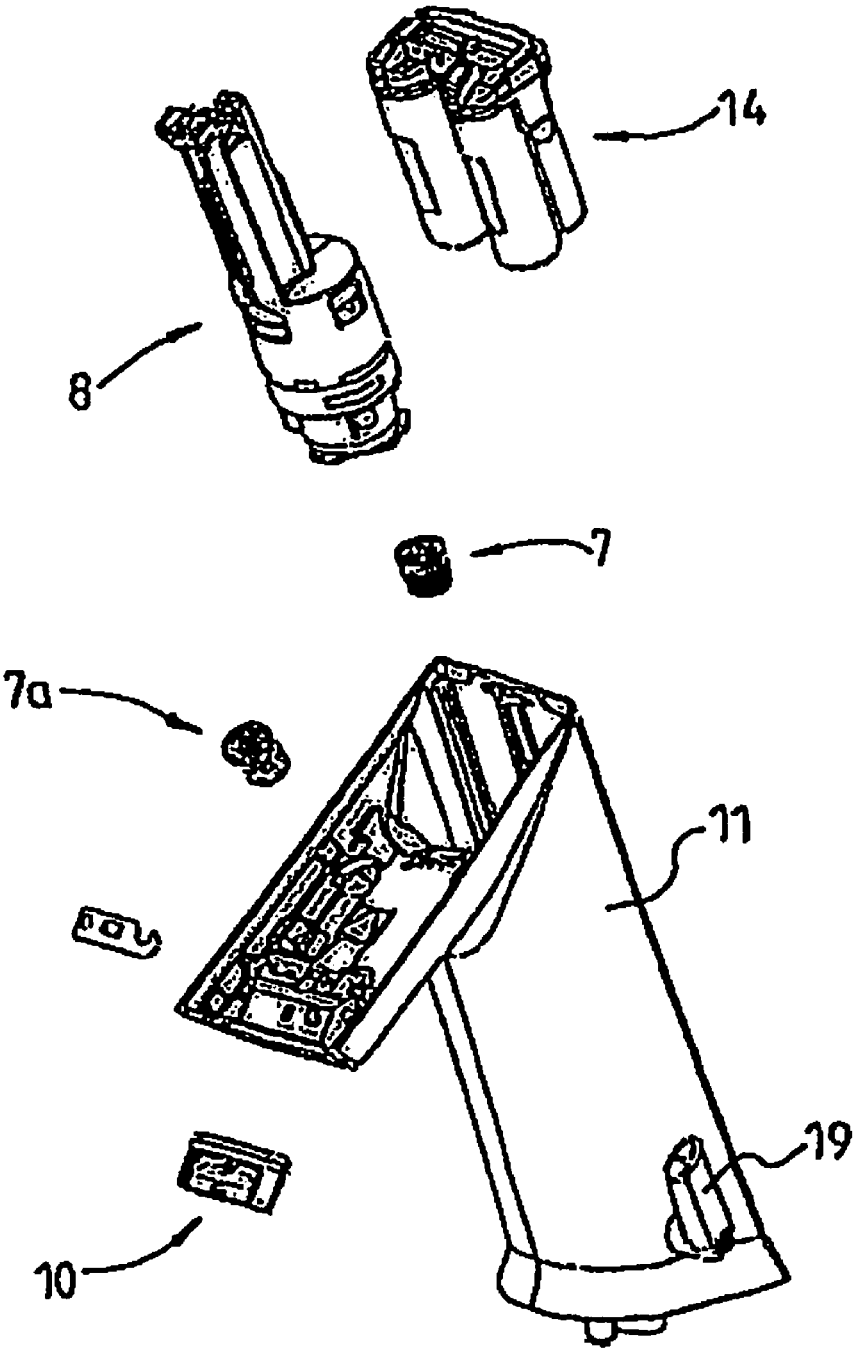

A sanitary fitting may optionally be operated with only one (cold) water feed 1, 2 or with two (hot and cold) water feeds 1, 2. In the latter case, a mixing valve 3 should preferably be provided such that the mixed water flows in a common water line 4.

A first control element 5 or shut-off valve 5 permits a separation at a (symbolically indicated) interface 6. The valve 5 is preferably actuated by virtue of a second control element 8 or a so-called valve unit 8 being dismounted, in particular removed by means of rotation or a bayonet coupling, such that the valve 5 is simultaneously closed.

The valve unit 8 preferably comprises a dirt filter 7 and a throughflow limiter 9 which are arranged, as viewed in the flow direction, downstream of the valve 5 or of the interface 6.

A solar cell 17 and/or a turbine 18 with electrical generator may optionally be provided, such that the flow energy of the water is converted into electrical energy. For example, batteries or storage batteries 14 are provided for supplying energy to the electrical components (if appropriate valve 8, display 16 and/or LED display, sensor not illustrated in any more detail, etc.) and/or for temporarily storing the electrical energy from the turbine 18 and/or solar cell 17.

A fitting main housing 11 is firmly fixed to the washbasin 12 or the like, and an assembly cover 13 can advantageously be released from and mounted/fixed again on the main body 11.

All relevant components can be removed and reinstalled through the free opening 13 of the main body 11. For example, through suitable configuration, it is not possible for an inexperienced user to identify that the cover 13 is removable. This is highly advantageous with regard to protection against vandalism.

LIST OF REFERENCE NUMERALS

1 Cold feed
2 Hot feed (optional)
3 Mixing valve (optional)
4 Mixed water
5 Service valve=shut-off valve
6 Hydraulic interface
7 Filter
8 Throughflow valve (may be electrical, mechanical valve, etc.)
9 Throughflow limiter or throughflow regulator
10 Outlet
11 Fitting housing or fitting main body
12 Installation platform (for example washbasin)
13 Assembly cover or opening
14 Storage batteries/batteries
15 Electrical button/switch
16 Display
17 Solar cell (optional)
18 Turbine with generator (optional)
19 Temperature adjustment lever (in the case of a mixing valve being used)

What is claimed is:

1. In a sanitary fitting having a fitting housing with an inlet feed, an outlet and a control unit for controlling water flow through at least one water line wherein the improvement comprises a shut off valve disposed in the fitting housing to open and close the at least one water line the fitting housing having at least one fitting main body for fixation to an installation site and a releasable assembly cover to cover a fitting housing opening for maintenance and/or servicing purposes, and at least one first shut-off device or a first control element disposed in the fitting housing and at least one second control element disposed in communication with said at least one first shut-off device and disposed inside said fitting housing and an interface (6) disposed in the fitting housing and connected to the first shut-off device or a first control element and the at least one second control element which serves for shutting off the at least one water line and allows the removal, repair or service of a dirt filter, throughflow valve, throughflow limiter, jet regulator, water turbine with an electrical generator, water line sections and/or electrical components without water escaping from the sanitary fitting.

2. The sanitary fitting as claimed in claim 1 wherein the second control element is a shut-off valve.

3. The sanitary fitting as claimed in claim 1 wherein the at least one second control element is arranged upstream of the first control element as viewed in the flow direction of the water flow.

4. The sanitary fitting as claimed in claim 1 wherein the cross section of the housing opening is larger than a cross section of the first control element.

5. The sanitary fitting as claimed in claim 1 further comprising at least one dirt filter for filtering the water flow or at least one throughflow regulator for regulating the water flow rate or at least one turbine and an electrical generator, to utilize the water flow energy of the water flow.

6. The sanitary fitting as claimed in claim 1 wherein the first control element is a dirt filter and/or a throughflow regulator and/or an electrical generator and/or a turbine.

7. The sanitary fitting as claimed in claim 6 wherein the first control element forms a shut off service unit jointly dismounted and/or mounted together with the dirt filter and/or the throughflow regulator and/or the electrical generator and/or the turbine.

8. The sanitary fitting as claimed in claim 1 further comprising at least one actuation unit to actuate the at least one second control element.

9. The sanitary fitting as claimed in claim 8 wherein the actuation unit is a fixing device for fixing and releasing the first control element and/or a service unit.

10. The sanitary fitting as claimed in claim 9 wherein the fixing device is a bayonet coupling.

11. The sanitary fitting as claimed in claim 1 wherein the releasable assembly cover is at least one actuation element for actuating the first and/or the at least one second control element.

12. The sanitary fitting as claimed in claim 11 wherein the releasable assembly cover includes at least one solar cell for solar electricity generation and/or is a display unit for displaying parameters of the water flow and/or parameters of the control unit.

13. A fitting housing and water control unit comprising:

(a) a fitting housing having at least one inlet water line and a substantially flat base on one end and a water outlet on another end;

(b) a water control valve disposed inside the fitting housing to open and close said at least one inlet water line;

(c) a shut off water control valve communicating with said water control valve and disposed inside the fitting housing to open, close and shut off said at least one water line;

(d) a control element disposed inside the fitting housing to open or close said water control valve or said shut off water control valve; and (e) an interface disposed inside the fitting housing and connected to the water control valve and the shut off water control valve to allow the removal, repair or service of the control element or components in the fitting housing wherein all the components needed to close the at least one water line are disposed in the fitting housing between the water outlet and the substantially flat base.

14. The fitting housing and water control unit of claim 13 wherein the control element is a releasable assembly cover.

15. The fitting housing and water control unit of claim 13 wherein the control element is a dirt filter, or a throughflow regulator, or an electrical generator or a water turbine.

16. The fitting housing and water control unit of claim 13 wherein said at least one inlet water inlet line is two water inlet lines one for cold water and one for hot water.

17. The fitting housing and water control unit of claim 16 further comprising a water mixing valve to mix said cold water with said hot water.

18. The fitting housing and water control unit of claim 17 further comprising a temperature adjustment lever disposed on an outside of said fitting housing.

19. A sanitary fitting housing comprising:

(a) a sanitary fitting housing having a base, an inside and an outside and a water inlet and a water outlet;

(b) a first water control valve disposed on the inside of the sanitary fitting housing connected to the water inlet;

(c) a second water control valve disposed on the inside of the sanitary fitting housing and connected to the first water control valve downstream from the first water control valve;

(d) an actuation unit disposed inside the sanitary fitting housing to open and close said first water control valve or shut off said second water control valve;

(e) an interface disposed on the inside of the sanitary fitting housing connected to the first water control valve and the second water control valve to allow the removal, repair or service of components inside the sanitary fitting housing without having to access a shut off valve disposed outside the sanitary fitting housing wherein the first water control valve, the second water control valve, the actuation unit and the interface are disposed within the fitting housing between the water outlet and the base; and (f) an assembly cover to close the inside of the sanitary fitting housing from the outside of the sanitary fitting housing, the assembly cover having a display unit and a solar cell.

20. The sanitary fitting housing of claim 19 wherein a rotational movement or travel of the first control element shuts off the second water control valve.

* * * * *